United States Patent [19]

Bril

[11] Patent Number: 4,458,441

[45] Date of Patent: Jul. 10, 1984

[54] BORED BLOCK AND STRIPS WITH PIN CONNECTORS

[76] Inventor: Alexander Bril, 7 Byalik St., Bnai-Brak, Israel

[21] Appl. No.: 317,742

[22] Filed: Nov. 3, 1981

[30] Foreign Application Priority Data

Nov. 5, 1980 [IL] Israel ..... 61420

[51] Int. Cl.[3] ..... A63H 33/12

[52] U.S. Cl. ..... 446/94; 446/103; 446/122; 446/113

[58] Field of Search ..... 46/16, 17, 23, 26

[56] References Cited

U.S. PATENT DOCUMENTS 1,974,838 9/1934 Schmid ..... 46/16
3,205,611 9/1965 Onanian ..... 46/16 X
3,660,927 5/1972 De Christopher ..... 46/17
3,854,237 12/1974 Loth ..... 46/26
3,975,858 8/1976 Much ..... 46/26

FOREIGN PATENT DOCUMENTS 899791 9/1944 France ..... 46/26
2229203 5/1973 France ..... 46/16

*Primary Examiner*—F. Barry Shay

[57] ABSTRACT

A constructional toy kit consisting of an L-shaped block and a U-shaped block, both provided with series of bores located and extending in directions as specified in the disclosure. The kit further includes pins, strips, bevelled blocks assembling blocks, discs and washers to enable the assembly of many different models.

11 Claims, 58 Drawing Figures

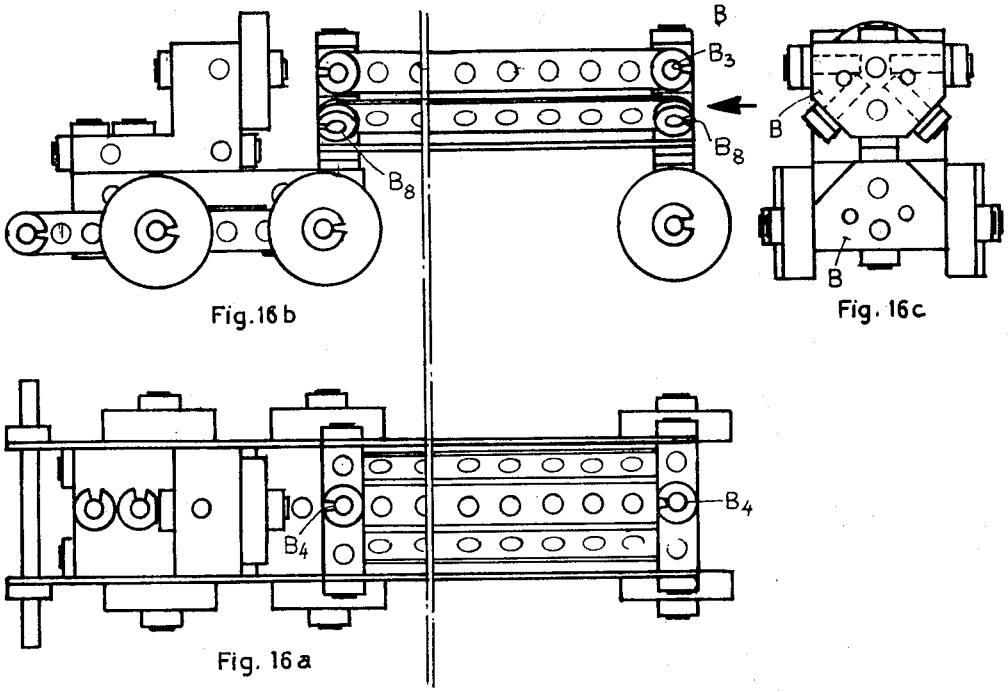
Fig. 16 b
Fig. 16 c
Fig. 16 a
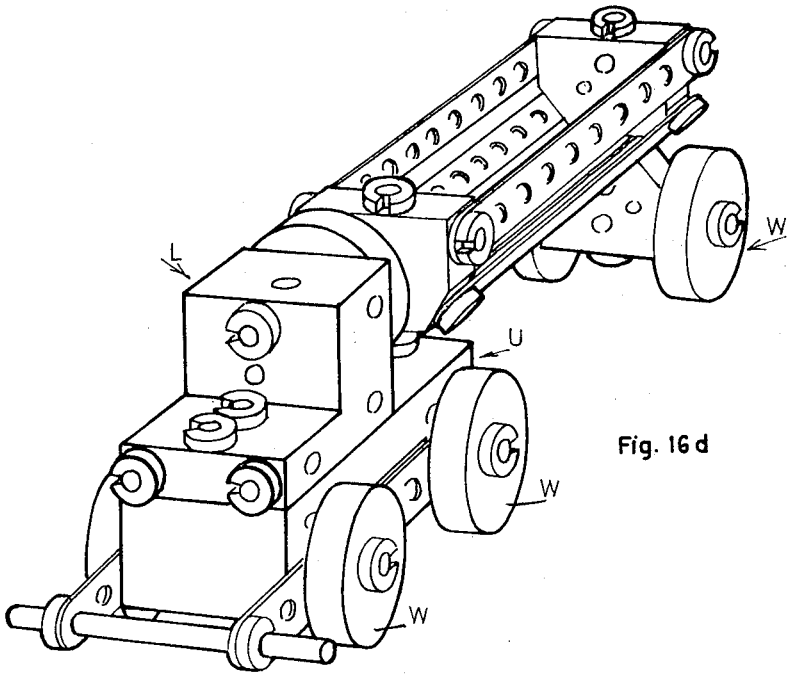
Fig. 16 d

BORED BLOCK AND STRIPS WITH PIN CONNECTORS

The present invention relates to construction or assembly toys of the kit type, including a number of differently shaped elements having bores drilled therein in various planes, and connected pieces such as pins, strips and discs for the assembly of the kit.

Various types of such toys are presently known, particularly for children of kindergarten ages and below, wherein only a few configurations can be assembled. I myself have invented and registered a patent in the U.S.S.R (No. 230019 dated 24.4.1967) for a construction toy of basically similar block elements as heretofore disclosed, but, again, allowing only a limited number of configurations to be assembled therefrom.

There are also known more sophisticated toys such as the well-known "Mechanno" series, comprising screws and bolts, such toys being however expensive, require a large number of components and are not suitable for small children.

It is a general object of the invention to provide a constructional toy comprising a minimum number of low cost, simple parts and assemblying components which, however, will enable the construction of many different configurations.

It is a further object of the invention to provide a constructional toy consisting essentially of only two, basic building elements.

It is a still further object of the invention that the two elements will be provided with an optimal, minimum number of bores, to reduce the overall production costs of the toy.

According to the invention there is provided a constructional toy consisting of:

a first, generally L-shaped block(L), provided with bores (L1, L2, . . ., L10) of a diameter (d) arranged according to the following coordinates:

L1—X=O; Y=O
L2—X=2P; Y=O
L3—X=3P; Y=O
L4—X=2½P; Z=O
L5—X=−½P; Z=O
L6—X=−½P; Z=2P
L7—Y=P; Z=O
L8—Y=−P; Z=O
L9—Y=O; Z=P
L10—Y=O; Z=2P wherein X-Y-Z are the axes of right-angled coordinates system at the intersection of the three planes of symmetry of the block, and P is a fixed length greater than the diameter (d) of the bores;

a second, generally U-shaped block (U) provided with bores (U1, U2, . . ., U14) arranged according to the following coordinates:

U1—X=0; Y=0
U2—X=2P; Y=0
U3—X=3P; Y=0
U4—X=−3P; Y=0
U5—X=−4P; Y=0
U6—X=1½P; Z=0
U7—X=2½P; Z=0
U8—X=2½P; Z=P
U9—X=−2½P; Z=0
U10—X=−2½P; Z=P
U11—X=−3½P; Z=0
U12—X=−3½P; Z=P

U13—Y=P; Z=P
U14—Y=−P; Z=P a set of pins (R) slidingly receivable within the bores;

a set of strips (S) having bores arranged equidistantly therealong; and a set of assemblying blocks (A) of a prismatic shape, provided with split bores extending in perpendicularly, crossing directions.

Additional, non-essential components of the toy may be included such as split discs, split washers, discs serving as wheels and double-bevel blocks having a variety of bores for frictionally receiving the pins. The bevelled blocks may include inserts for more safely lock the pins in their bores.

Figure 1C:
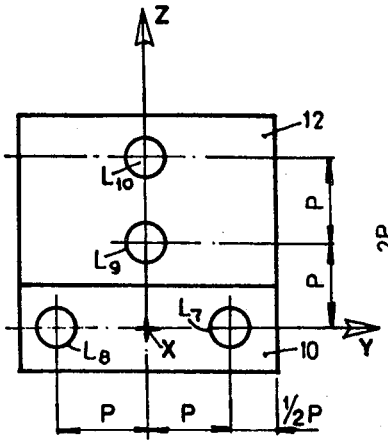
Figure 1B:
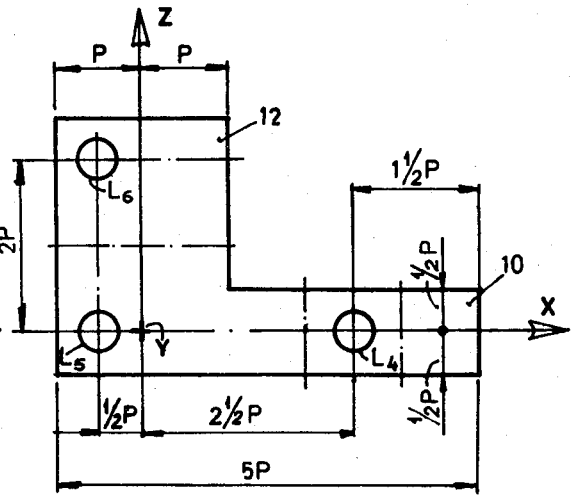
Figure 1A:
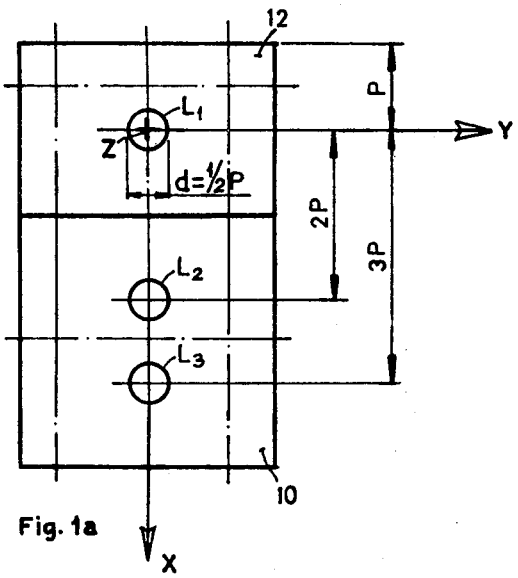

These and further constructional details and advantages of the present invention will be better understood in the light of the ensuing description, given by way of example only, with reference to the accompanying drawings, wherein FIG. 1*a* is a top-view of an L-shaped building block element forming one of the main components of the constructional toy according to the present invention;

FIG. 1*b* is a side-view of the block shown in FIG. 1*a;*

FIG. 1*c* is a front-view of the block of FIG. 1*a;*

Figure 1D:
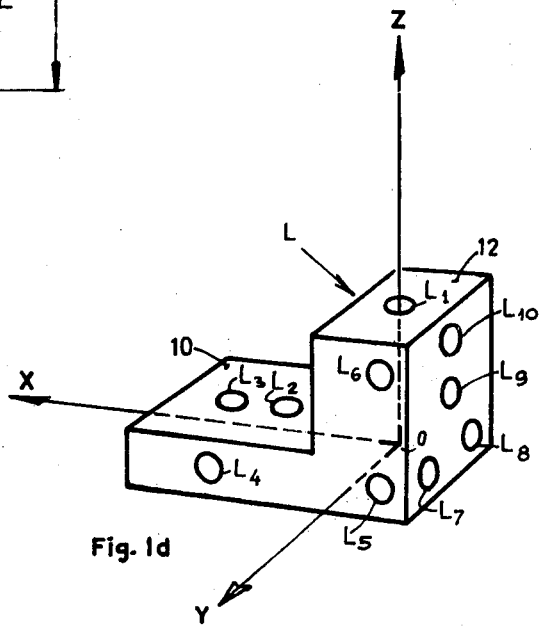

FIG. 1*d* is a three-dimensional view of the block of FIGS. 1*a*–1*c;*

Figure 2B:
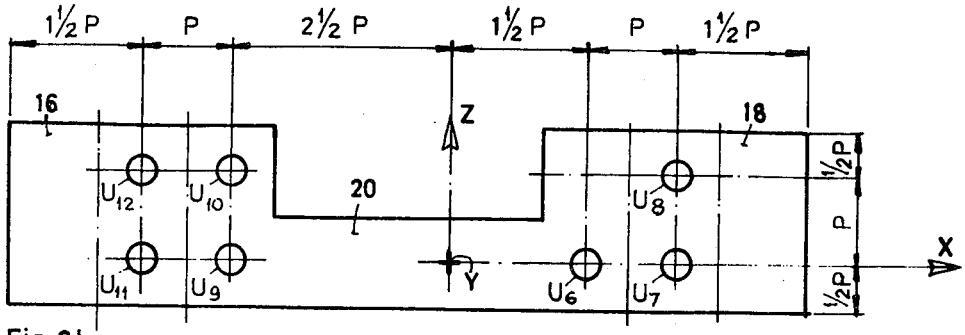
Figure 2A:
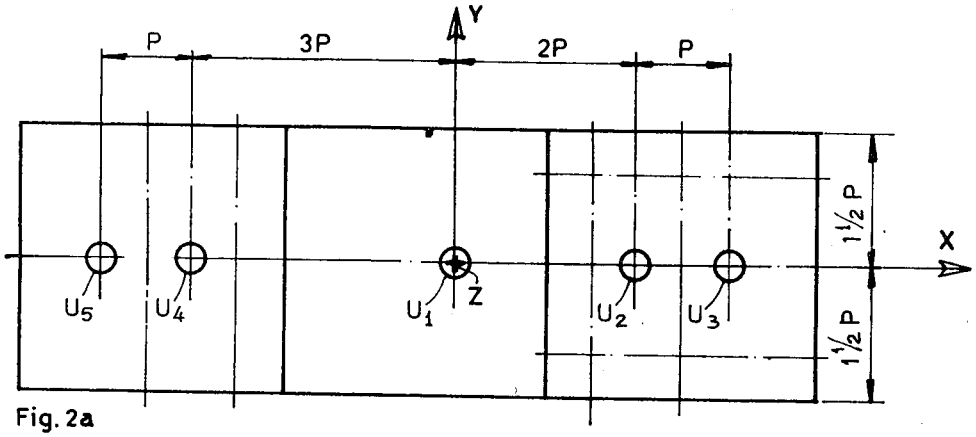

FIG. 2*a* is a top-view of a U-shaped building block;

FIG. 2*b* is a side-view of the block of FIG. 2*a;*

Figure 2C:
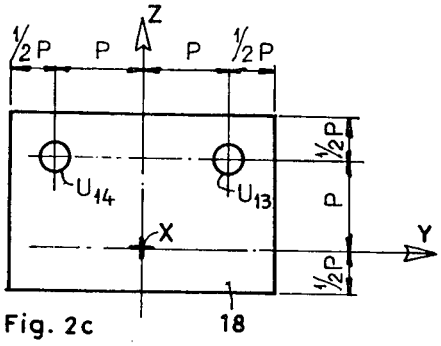

FIG. 2*c* is a front-view of the block of FIG. 2*a;*

Figure 2D:
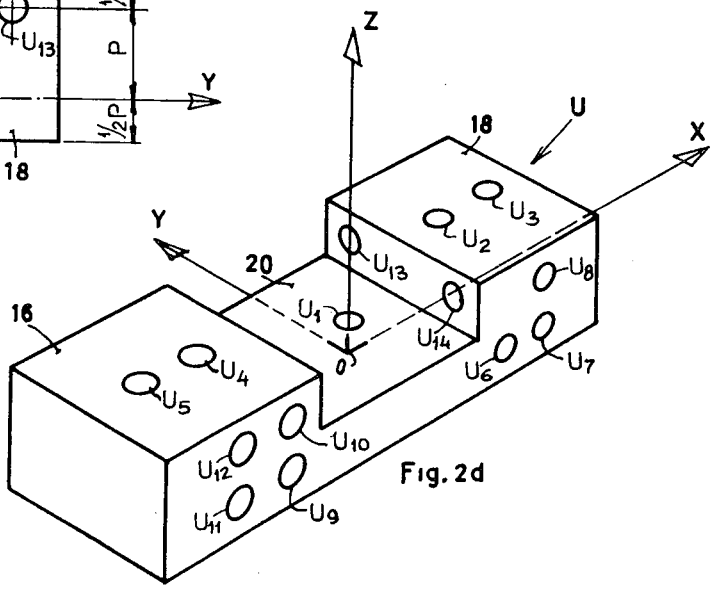

FIG. 2*d* is a three-dimensional view of the block shown in FIGS. 2*a*–2*c;*

Figure 3A:
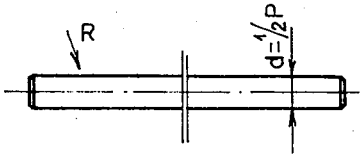
Figure 3B:
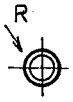
Figure 4A:
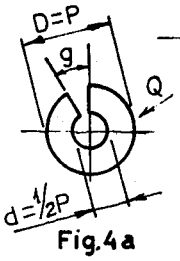
Figure 4B:
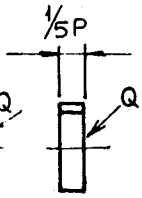
Figure 5A:
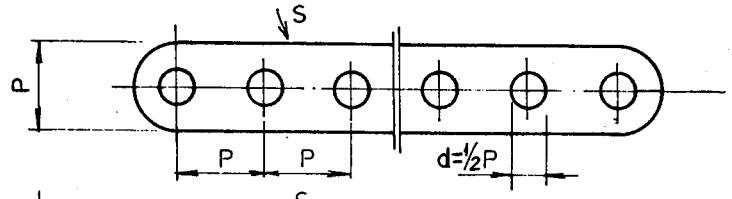
Figure 5B:
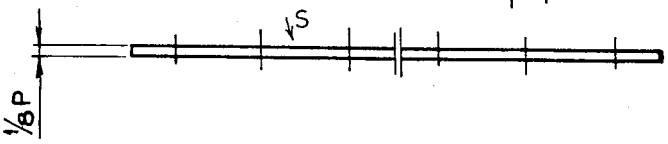
Figure 6A:
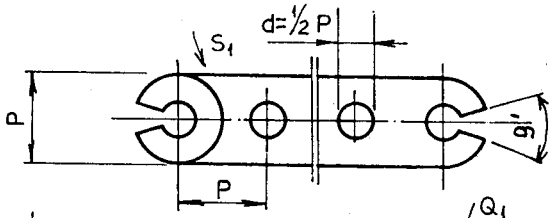
Figure 6B:
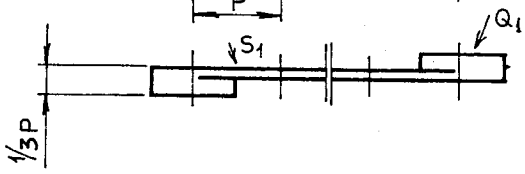
Figure 7A:
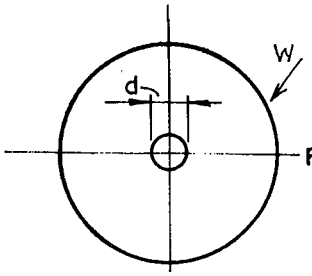
Figure 7B:
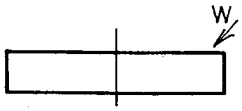
Figure 8A:
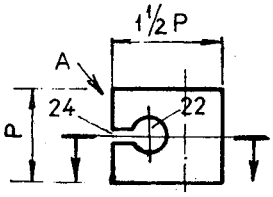
Figure 8B:
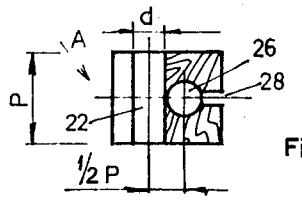
Figure 9C:
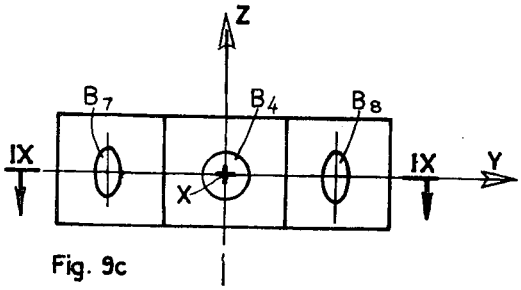
Figure 9B:
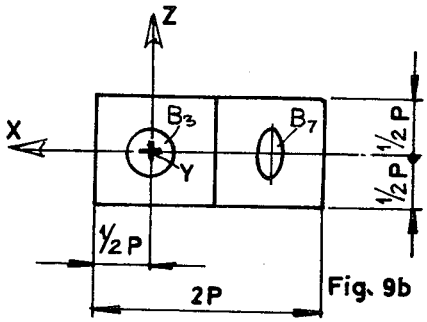
Figure 9A:
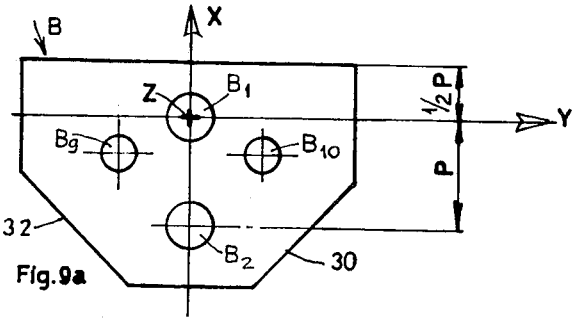

FIGS. 3*a* and 3*b* are, respectively, front-and side-views of a pin used in the constructional toy according to the present invention;

FIGS. 4*a* and 4*b* are, respectively, front-and side-views of a split disc;

FIGS. 5*a* and 5*b* are, respectively, top-and side-views of a perforated strip used for the purposes of the present invention;

FIGS. 6*a* and 6*b* are, respectively, top-and side-views of a modified strip;

FIGS. 7*a* and 7*b* are, respectively, top-and side-views of a disc forming wheels for the toy according to the present invention;

FIGS. 8*a* and 8*b* are, respectively, side-and cross-sectional views of an assembling block according to the present invention;

FIG. 9*a* is a top-view of a double-bevel block according to the present invention;

FIG. 9*b* is a side-view of the block of FIG. 9*a;*

FIG. 9*c* is a front-view of the block of FIG. 9*a;*

Figure 9D:
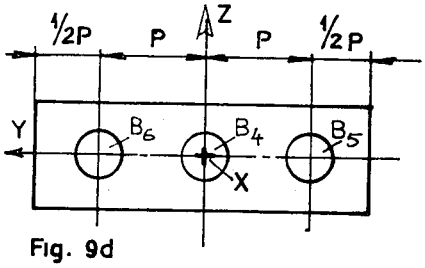

FIG. 9*d* is a rear-view of the block of FIG. 9*a;*

Figure 9F:
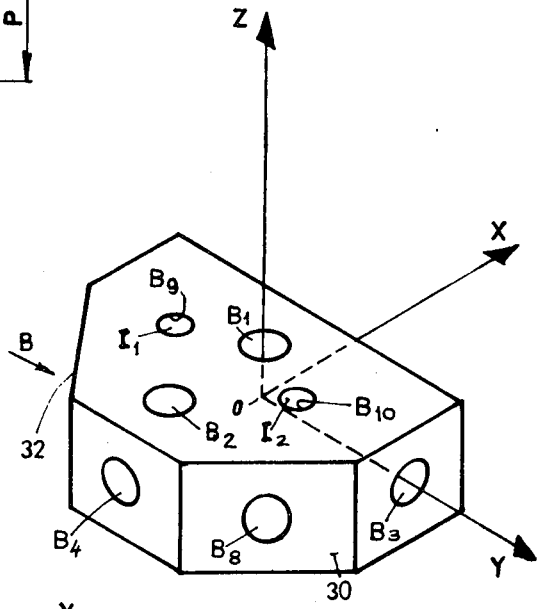
Figure 9E:
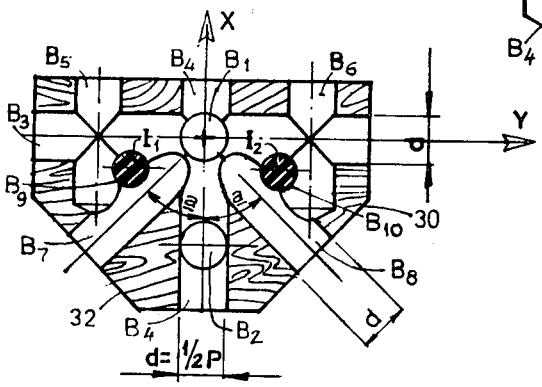

FIG. 9*e* is a cross-sectional taken along lines IX—IX of FIG. 9*c;*

FIG. 9*f* is a three-dimensional view of the block of FIGS. 9*a*–9*e;*

Figure 10D:
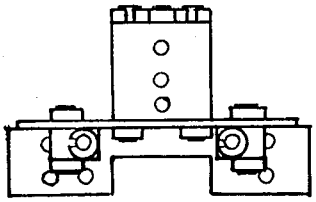
Figure 10C:
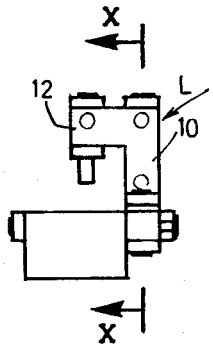
Figure 10B:
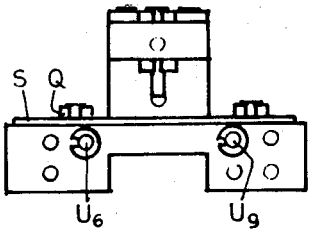
Figure 10A:
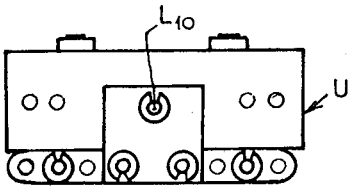

FIG. 10*a* is a top-view of a drilling machine model constructed of the elements according to the present invention;

FIG. 10*b* is a front-view of the model of FIG. 10*a;*

FIG. 10*c* is a side-view of the model of FIG. 10*b;*

FIG. 10*d* is a rear-view of the model of FIG. 10*a;*

Figure 10E:
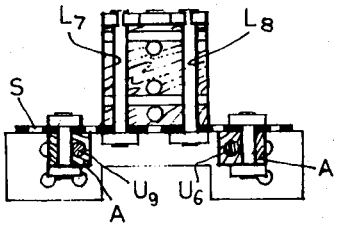

FIG. 10*e* is a cross-section taken along lines X—X of FIG. 10*c;*

Figure 10F:
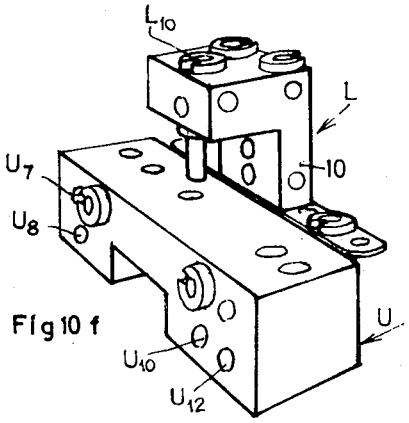

FIG. 10*f* is a three-dimensional view of the model shown in FIGS. 10*a*–10*e;*

Figure 11A:
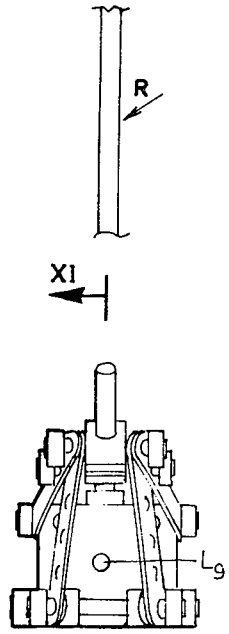
Figure 11C:
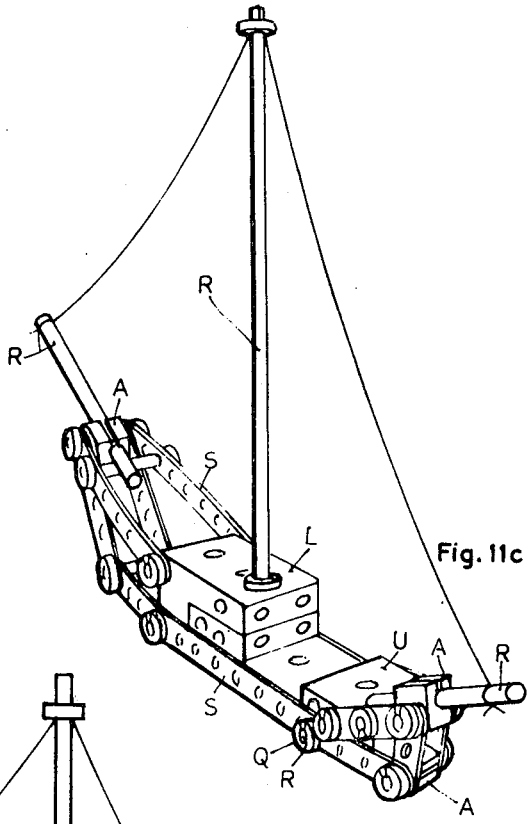
Figure 11B:
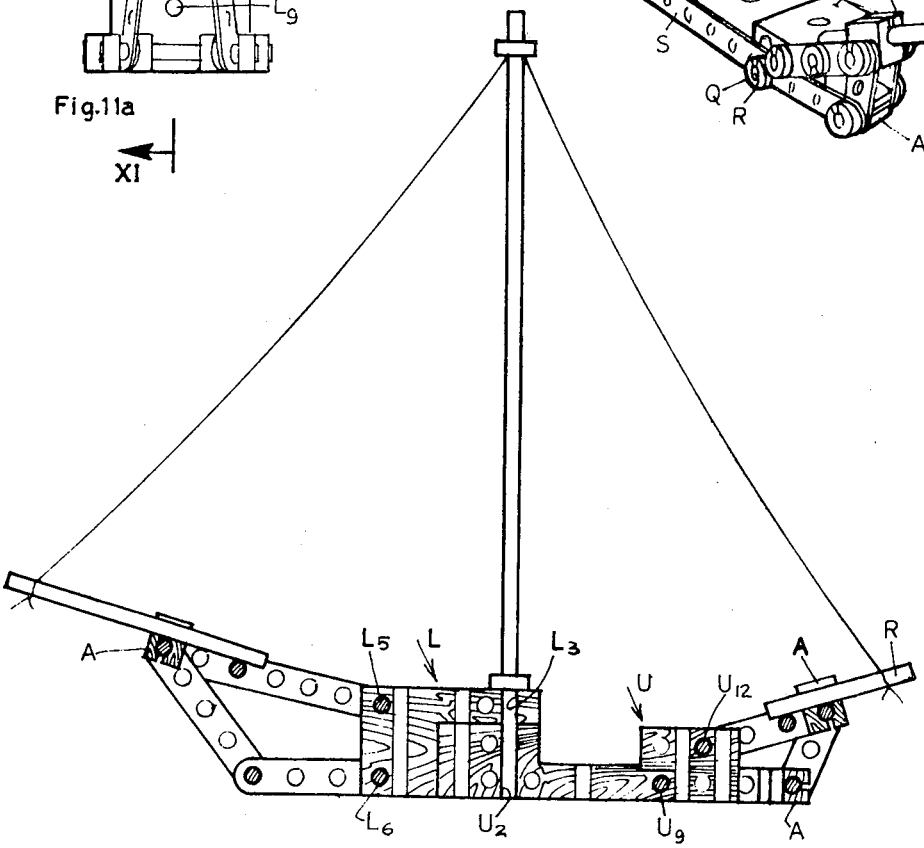

FIG. 11*a* is a front-view of a ship model constructed from the elements according to the present invention;

FIG. 11*b* is a side cross-sectional view taken along lines XI—XI of FIG. 11*a;*

FIG. 11*c* is a three-dimensional view of the ship model shown in FIGS. 11*a*–11*b;*

Figure 12B:
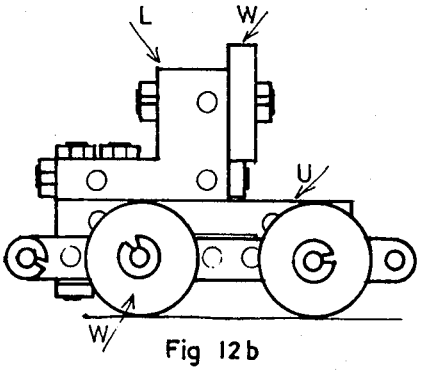
Figure 12C:
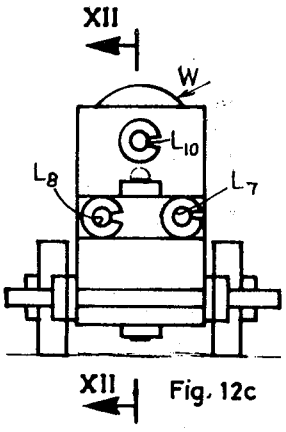
Figure 12A:
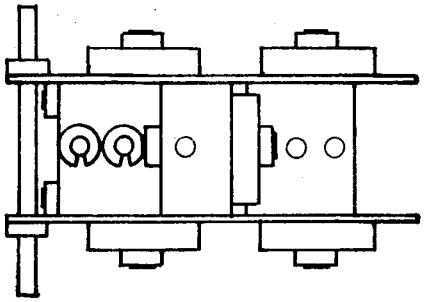

FIG. 12*a* is a top-view of an armoured vehicle model constructed according to the present invention;

FIG. 12*b* is a side-view of the model of FIG. 12*a;*

FIG. 12*c* is a front-view of the model of FIG. 12*b;*

Figure 12D:
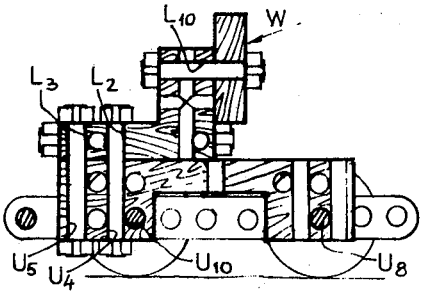

FIG. 12*d* is a cross-sectional view taken along lines XII—XII of FIG. 12*c;*

Figure 12E:
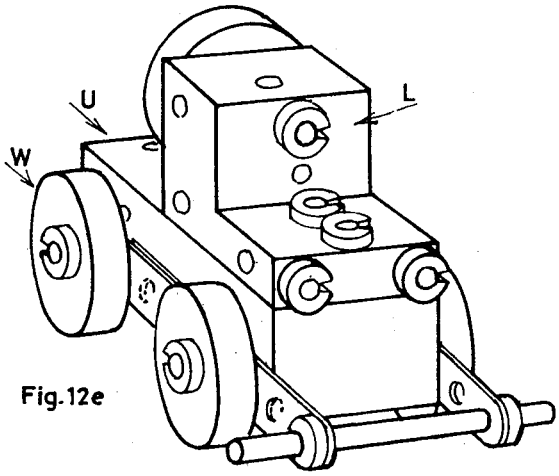

FIG. 12*e* is a three-dimensional view of the model shown in FIGS. 12*a*–12*d;*

Figure 13A:
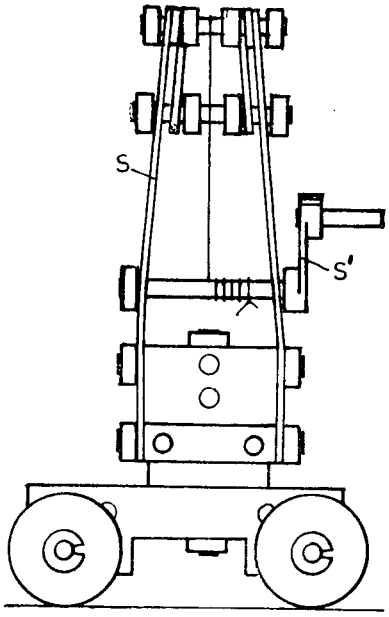
Figure 13B:
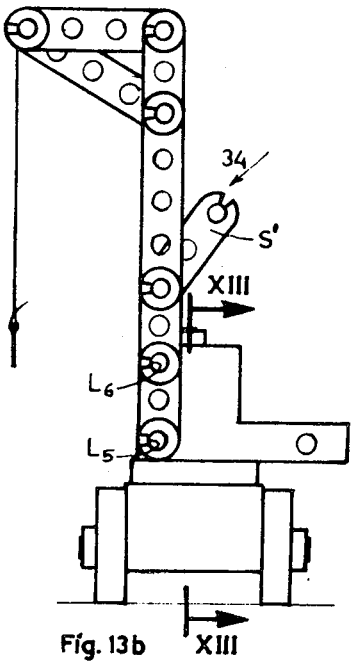

FIG. 13*a* is a side-view of crane model constructed according to the present invention;

FIG. 13*b* is a front-view of the model of FIG. 13*a;*

Figure 13D:
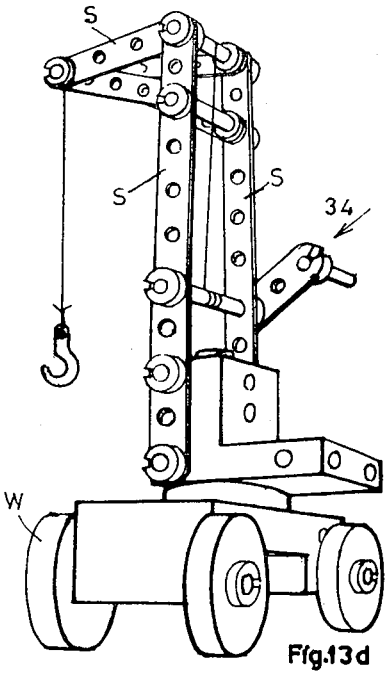
Figure 13C:
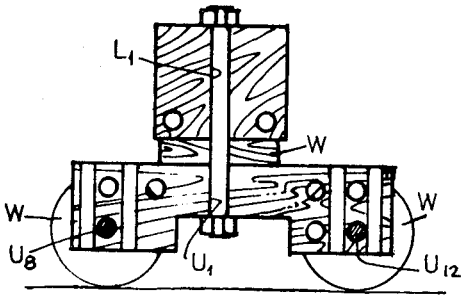

FIG. 13*c* is a cross-section taken along lines XIII—XIII of FIG. 13*b;*

FIG. 13*d* is a three-dimensional view of the model shown in FIGS. 13*a*–13*c;*

Figure 14B:
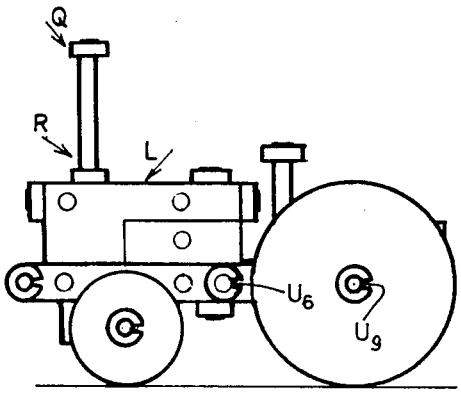
Figure 14C:
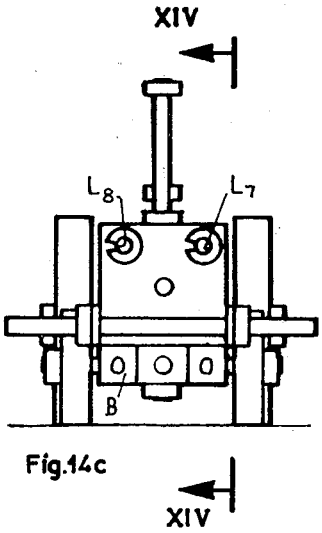
Figure 14A:
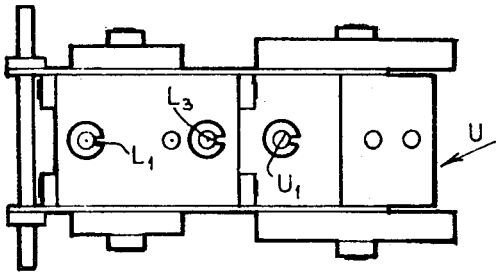

FIG. 14*a* is still another vehicle model constructed according to the present invention;

FIG. 14*b* is a side-view of the model of FIG. 14*a;*

FIG. 14*c* is a side-view of the model of FIG. 14*b;*

Figure 14D:
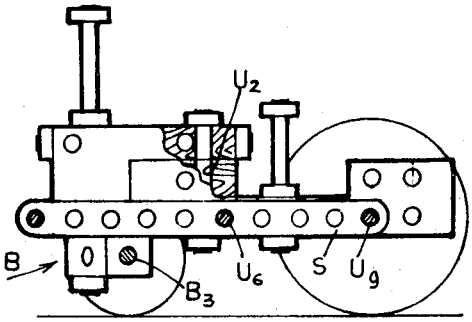

FIG. 14*d* is a cross-section taken along lines XIV—XIV of FIG. 14*c;*

Figure 14E:
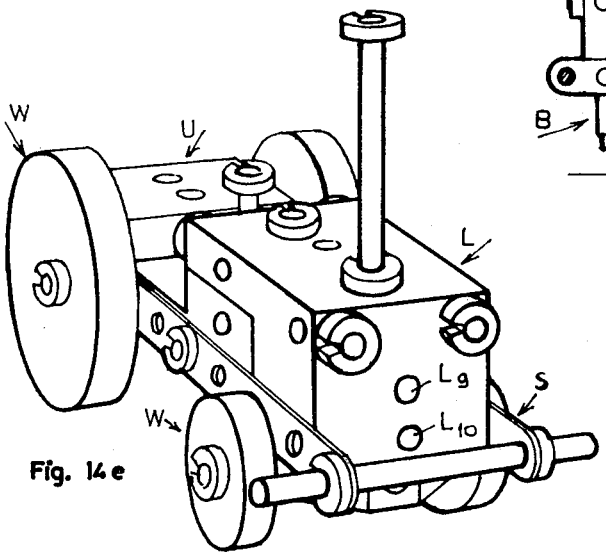

FIG. 14*e* is a three-dimensional view of the model shown in FIGS. 14*a*–14*d;*

Figure 15B:
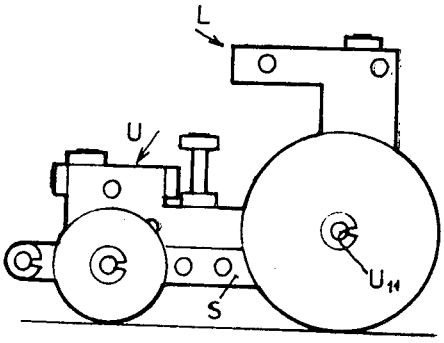
Figure 15C:
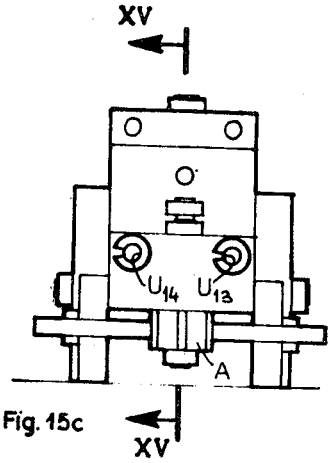
Figure 15A:
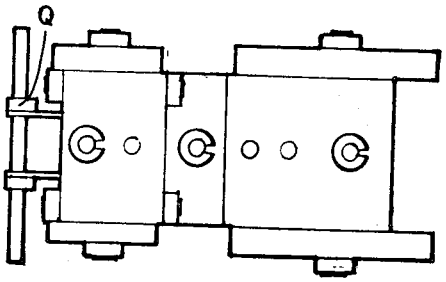

FIG. 15*a* is a top-view of another vehicle model constructed according to the present invention;

FIG. 15*b* is a side-view of the model of FIG. 15*a;*

FIG. 15*c* is a side-view of the model of FIG. 15*b;*

Figure 15D:
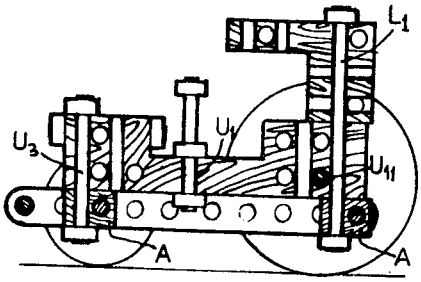

FIG. 15*d* is a cross-sectional view taken along lines XV—XV of FIG. 15*b;*

Figure 15E:
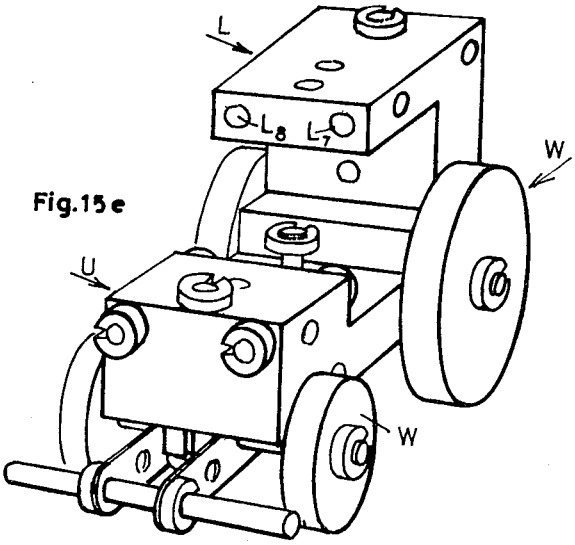

FIG. 15*e* is a three-dimensional view of the model shown in FIGS. 15*a*–15*d;*

FIG. 16*a* is a top-view of a tanker vehicle constructed according to the present invention;

FIG. 16*b* is a side-view of the model of FIG. 16*a;*

FIG. 16*c* is a side-view of the model of FIG. 16*b;* and

FIG. 16*d* is a three-dimensional view of the vehicle shown in FIGS. 16*a*–16*c;*

FIGS. 1*a*–1*d* show the first basic component of the constructional toy, being in the form of an L-shaped block, preferably made of wood, having a first leg 10, and a second leg 12 of a greater width than the leg 10. A plurality of through-going bores L1, L2, . . . , L10 are drilled in the block, as shown.

For better defining the location and direction of the bores, reference will be made to the three-dimensional coordinate system, X-Y-Z the origin O thereof is located at the intersection of the three planes of symmetry of the block, as shown.

Accordingly, as best seen in FIG. 1*a* with respect to bores extending in the direction of the axis Z, there are provided the following bores:

L1—X=0; Y=0
L2—X=2P; Y=0
L3—X=3P; Y=0 as seen in FIG. 1*b* with respect to bores extending in the direction of the axis Y, the coordinates are as follows:

L4—X=2½P; Z=0
L5—X=−½P; Z=0
L6—X=−½P; Z=2P and with respect to bores extending in the direction of the axis X, the coordinates are (see FIG. 1*c*):

L7—Y=p; Z=0
L8—Y=−P; Z=0
L9—Y=0; Z=P
L10—Y=0; Z=2P

As above stated, this particular design and distribution of these specific ten bores was a result of an extensive research and optimization considerations so that no more and no more less bores will be utilized, as will be substantiated by the various examples given further below.

The second basic element U, shown in FIGS. 2*a*–2*d*, is U-shaped, having a first leg 16, a second leg 18 and a web, bridging portion 20, and provided with bores defined with respect to the axes system X-Y-Z as shown in FIG. 2*d*, whereas the coordinates of the various bores U1, U2, . . ., U14 are as follows:

U1—X=0; Y=0
U2—X=2P; Y=0
U3—X=3P; Y=0
U4—X=−3P; Y=0
U5—X=−4P; Y=0
U6—X=1½P; Z=0
U7—X=2½P; Z=0
U8—X=2½P; Z=P
U9—X=−2½P; Z=0
U10—X=−2½P; Z=P
U11—X=−3½P; Z=0
U12—X=−3½P; Z=P
U13—Y=P; Z=P
U14—Y=−P; Z=P

It will be noted that the bores U13 and U14 are provided only in the leg 18 but not in the leg 16.

In addition to these two main or basic blocks L and U there are employed a number of auxiliary components as follows: Pins R shown in FIGS. 3*a* and 3*b*, of different lengths, and a diameter d so as to become frictionally received within the various bores L or U of the L-shaped and U-shaped blocks; split discs Q shown in FIGS. 4*a* and 4*b* having a gap g, an inner diameter d and an outer diameter D, made of a springy material such as plastics so as to become frictionally engaged on the pins R; strips S as shown in FIGS. 5*a* and 5*b*, being alongated and provided with a plurality of aligned bores of the diameter d(d=½P), or, alternatively strips S′ examplified in FIGS. 6*a* and 6*b* wherein a pair of discs Q′ with gaps g′, similar to those shown in FIG. 4, are integrally formed at the free ends of the strip; discs W shown in FIGS. 7*a* and 7*b* having an internal bore of the diameter d, and different outer diameter which discs serve as vehicle wheels (see below); and assembly blocks A (FIGS. 8*a*–8*b*) being essentially of a prismatic shape and having a first bore 22 extending in one longitudinal direction of the block and split therealong to provide a gap 24 and a second bore 26 and gap 28 extending in a perpendicular crossing direction. The diameter of the bores 22 and 26 is again equal substantially to d for the interaction with the pins R (FIG. 3).

Now, with reference to FIGS. 9*a*–9*f* there is shown a double-bevelled block designated B which is generally square except for two corners being cut away to form bevel planes 30 and 32.

The location of the various bores B1, B2, . . . , B6 is defined by their X-Y-Z coordinates, wherein the plane X-Y is a horizontal plane of symmetry of the block B, plane X-Y is a vertical plane of symmetry, and the axis Z is co-axial with bore B1 located in the plane X-Z, at a lower region of the block B.

Accordingly, the coordinates of the bores are as follows:

B1—X=0; Y=0
B2—X=−P; Y=0

B3—X=0; Z=0
B4—Y=0; Z=0
B5—Y=—P; Z=0
B6—Y=P; Z=0

In addition, there are provided a pair of bores B7 and B8 whose axes form acute angles a with the axis of the bore B4, as shown in FIG. 9*e*.

According to another aspect of the present invention there are provided in the block B a pair of inserts I1, I2 in such location and of such diameter so that the outer contour thereof projects to a small extent into adjacent bores, as follows: Insert I1 projects into the cavities of bores B3, B5 and B7, and the contour of insert I2 projects into the bores B3, B6 and B8.

The projected portions of the inserts form frictional stops for pins R to be inserted into the respective bores.

A selection of models which can be constructed using the basic elements of the constructional toy kit will be now described, bearing however in mind that these are only few examples of a large variety that may be built, depending on the imagination and skill of the user.

In FIGS. 10*a*–10*f* there is shown a toy model of a drilling machine built in the following manner. Block U is the base to which there are connected a pair of the assembling blocks A, using pins R (and split discs Q) passed through bores U6 and U9, as best seen in FIG. 10*e*. The blocks A form a support for a strip member S onto which the L-shaped block L is mounted by a pair of pins (and split rings Q) passing through the bores L7 and L8 of the leg 10. The other overhanging leg 12 of the block L is provided with a pin passed through the bore L10 representing the head of the drilling machine.

The example of FIGS. 11*a*–11*c* is of boat model, again comprising the blocks U and L connected as shown by the pins R one of which serving as a mast of the boat, passing at its lower end through the bores L3 and U2.

The structure further comprises a number of strips S and 3 assembling blocks A at the prow and the stern of the boat, using the bores L5, L6, U9 and U12 as more clearly seen in FIG. 11*b*.

For building the armoured vehicle model shown in FIGS. 12*a*–12*e*, the block U and the block L are connected in a back-to-back position by pins R passing through bores L3, L2 and U4 and U5; U8 and U10 are used for mounting the wheels W; bores U10 and U8 for mounting the strips carrying the front bumper of the vehicle; bore L10 is used for mounting the gun; and bores L7 and L8 are used to form the headlights.

In FIGS. 13*a*–13*d* there is shown a crane model comprising the U block in an up-side-down position whereby bores U12 and U8 support front and rear wheels W.

The tower or superstructure of the crane comprises a wheel W and the L block, both mounted by a pin R passing through bores L1 and U1. Strips S are attached to the block L by using the bores L5 and L6.

Hoisting crank-arm 34 includes the modified strip member S'.

The remaining illustrations, of other types of vehicles, shown in FIGS. 14, 15 and 16 need not be described in more detail since the drawings are self-explanatory. It will be noted, although, that in these examples use is made of the double-bevel blocks B, as shown.

It will be thus readily appreciated by those skilled in the art to which the present invention pertains that the constructional toy according to the invention is unique in that it employs only a small number of essential parts, it is simple in construction and low-cost in manufacturing and processing, keeping also in mind that each phase of production, such as drilling a hole or shaping a surface in a workpiece, expresses itself by large sums of money, in processing and production equipment.

As aforesaid, this achievement, heretofore unknown in this field of constructional toys assembling kits, was a result of an extensive research and many experiments. I myself have constructed from one set of the toy components as above described over 60 different models, and found out that the toy presents an incentive and a creative challenge for children to try and develop more and more different models.

In practice, except for the split rings Q and the strips S it would be advisable to make the components of wood, giving a more pleasant feeling and conveniency in handling.

The measures of the building bricks of a toy may differ, starting from big dimensions for smaller children, and vice-versa.

It will be further emphasized that the arrangement of the inserts as described with reference to the double-bevelled blocks B is unique and that it provides safe and easy to manufacture arrangement for locking the pins in their respective bores.

It would be appreciated that this invention may be embodied in several forms without departing from the spirit or essential characteristics thereof, the present embodiments are therefore illustrative and not restrictive, and since the scope of the invention is defined by the appended claims all changes that fall within the mets and bounds of the claims, or that form the functional as well as conjointly cooperative equivalents, are therefore intended to be embraced by those claims.

What is claimed is:

1. A constructional toy consisting of:

a first, generally L-shaped block (L), provided with bores (L1, L2, . . . , L10) of a diameter (d) arranged according to the following coordinates:

L1: X=0; Y=0
L2: X=2P; Y=0
L3: X=3P; Y=0
L4: X=2½P; Z=0
L5: X=—½P; Z=0
L6: X=—½P; Z=2P
L7: Y=P; Z=0
L8: Y=—P; Z=0
L9: Y=0; Z=P
L10: Y=0; Z=2P wherein X-Y-Z are the axes of right-angles coordinates system at the intersection of the three planes of symmetry of the block, and P is a fixed length greater than the diameter (d) of the bores;

a second, generally U-shaped block (U) provided with bores (U1, U2, . . . , U14) arranged according to the following coordinates.

U1: X=0; Y=0
U2: X=2P; Y=0
U3: X=3P; Y=0
U4: X=—3P; Y=0
U5: X=—4P; Y=0
U6: X=1½P; Z=0
U7: X=2½P; Z=0
U8: X=2½P; Z=P
U9: X=—2½P; Z=0
U10: X=—2½P; Z=P
U11: X=—3½P; Z=0

U12: $X=-3\frac{1}{2}P$; $Z=P$

U13: $X=P$; $Z=P$

U14: $Y=-P$; $Z=P$;

- a set of pins (R) slidingly receivable within the bores;
- a set of strips (S) having bores arranged equidistantly therealong; and
- a set of assembling blocks (A) of a prismatic shape, provided with split bores extending in perpendicularly, crossing directions.

2. The toy as claimed in claim 1 further including washers frictionally receivable on said pins.

3. The toy as claimed in claim 2 wherein the washers are split.

4. The toy as claimed in claim 3 wherein said strips are provided at their free ends with two of said washers, integrally formed with the strips.

5. The toy as claimed in claim 4 further including a set of discs serving as wheels.

6. The toy as claimed in claim 1 further including a double-bevel block (B) having a plurality of bores for frictionally receiving said pins.

7. The toy as claimed in claim 6 wherein said bores (B1, B2, . . . , B6) of said double-bevel block (B) are arranged according to the following coordinates:

B1: $X=0$; $Y=0$

B2: $X=-P$; $Y=0$

B3: $X=0$; $Z=0$

B4: $Y=0$; $Z=0$

B5: $Y=-P$; $Z=0$

B6: $Y=P$; $Z=0$

8. The toy as claimed in claim 7 wherein two additional bores (B7, B8) are provided in said double-bevel block, each extending at an acute angle with respect to and intersecting one of the other bores thereof (B4).

9. The toy as claimed in claim 8 wherein said additional bores (B7, B8) extend at right-angles to the bevelled surfaces of said double-bevel block (B).

10. The toy as claimed in claim 9 wherein said double-bevel block (B) further comprises inserts partly projecting into the cavities of bores thereof to form a friction grip with the pins inserted therein.

11. The toy as claimed in claim 10 comprising two inserts (I1, I2) associated with said double-bevel block, each having a circular cross-section, one said insert associated with three of the bores thereof (B3,B5 and B7) and the other with three of the bores thereof (B3, B6 and B8).

* * * * *